US005438850A

United States Patent [19]

Keating et al.

[11] Patent Number: 5,438,850

[45] Date of Patent: Aug. 8, 1995

[54] BUTTON JEWELRY DEVICE

[76] Inventors: Patsy Keating, 5415 W. 99th Ter., Overland Park, Kans. 66207; Marty Postlethwait; Eric Postlethwait, both of 14501 S. Darnell, Olathe, Kans. 66062

[21] Appl. No.: 96,038

[22] Filed: Jul. 22, 1993

[51] Int. Cl.[6] ..... A44C 7/00

[52] U.S. Cl. ..... 63/2; 63/12; 63/20

[58] Field of Search ..... 63/12, 13, 14.1, 14.4, 63/14.5, 2, 20, 1.1; 24/615, 625

[56] References Cited

U.S. PATENT DOCUMENTS

| | | | |
|---|---|---|---|
| 3,088,295 | 5/1963 | Haines | 63/20 |
| 4,655,054 | 4/1987 | Roesch | 63/13 |
| 4,783,974 | 11/1988 | Hernandez | 63/2 |
| 5,048,310 | 9/1991 | Riley | 63/13 |
| 5,048,311 | 9/1991 | Mastrobuono | 63/12 |

FOREIGN PATENT DOCUMENTS

| | | | |
|---|---|---|---|
| 570 | of 1907 | United Kingdom | 63/20 |
| 752167 | 7/1956 | United Kingdom | 63/13 |
| 9111934 | 8/1991 | WIPO | 63/12 |

*Primary Examiner*—Flemming Saether
*Attorney, Agent, or Firm*—Kokjer, Kircher, Bowman & Johnson

[57] ABSTRACT

A device for button jewelry has a mounting member for releasably engaging a button. The mounting member is adapted for insertion through the eyelet on the rear face of a button and releasably engages the eyelet. One or more upwardly extending elements, or alternatively an indented portion, on the mounting member inhibit movement of the button and mounting member with respect to each other. A clip, pin, or post and backing (as commonly used on pierced earrings) is attached to the mounting member.

15 Claims, 1 Drawing Sheet

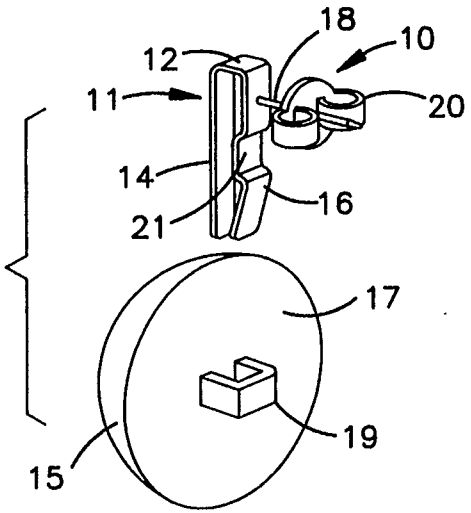
Fig. 1.
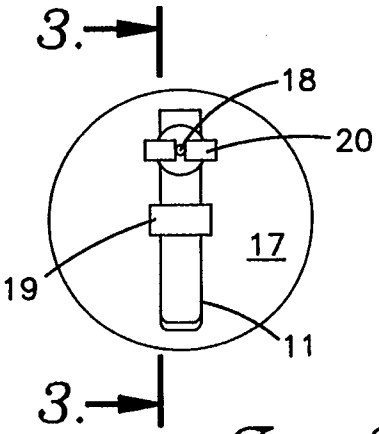
Fig. 2.
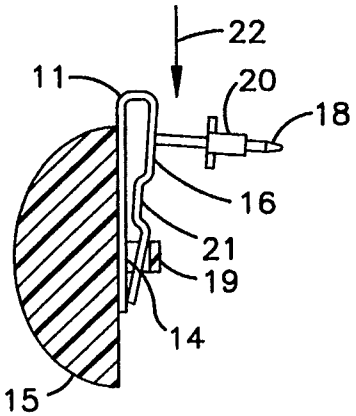
Fig. 3.
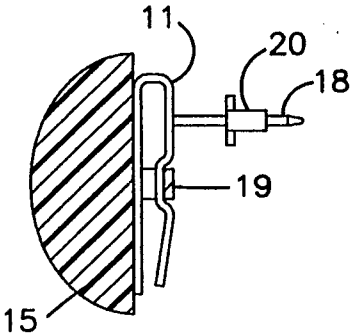
Fig. 4.
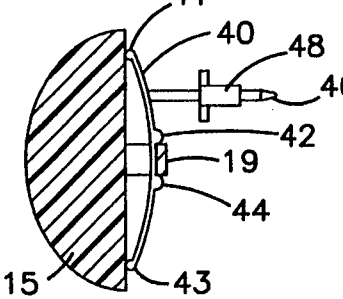
Fig. 5.
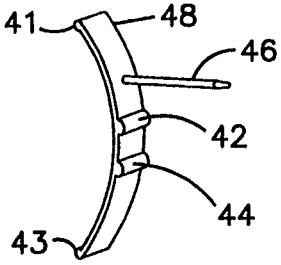
Fig. 6.
Fig. 7.
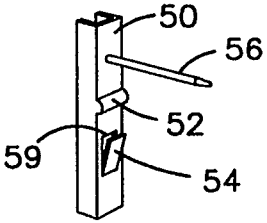
Fig. 8.
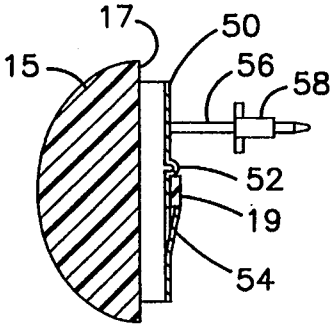
Fig. 9.

BUTTON JEWELRY DEVICE

BACKGROUND OF THE INVENTION

1. Field of the Invention

The present invention relates in general to jewelry, and particularly to earrings. More specifically, the present invention relates to a device for engaging buttons commonly used for clothing apparel, thereby permitting such buttons to be adapted for jewelry items.

2. Description of the Related Art

The abundant styles of clothing and apparel accessories available today offer consumers a wide variety of fashion choices. In selecting garments and other wearing apparel, individuals often attempt to match colors and styles of the various articles of clothing or accessories that they intend to wear. Moreover, it is often desired that jewelry items in some way match, or at least are not inconsistent with, the style of clothing a person selects to wear. In this regard, many styles, shapes and colors of jewelry, including earrings, are available which may be selected to accentuate certain features of an individual or their clothing. However, in many instances, it is difficult or impossible to find a jewelry item which precisely matches a particular feature of the clothing an individual desires to wear.

Additionally, much of today's clothing includes fanciful buttons utilized both for buttoning the garment and to lend a distinct visual appearance to the garment. This seems to be especially true with respect to women's dresses and suits. Most of these buttons include a face of some particular shape or design, with a substantially flat rear surface having an eyelet thereon through which thread may be sewed to secure the button to the garment. In comparison to the general overall cost of such a garment, the cost of the buttons thereon is generally extremely inexpensive in comparison. In fact, many clothing items come equipped with extra buttons.

In view of the foregoing, it is desirable to provide a device for engaging a button having an eyelet thereon, which device adapts the button to a jewelry item, and preferrably an earring. Accordingly, earrings may be constructed in accordance with the principles of the present invention which match the buttons on a particular garment.

SUMMARY OF THE INVENTION

The present invention comprises a relatively small mounting member for engaging the eyelet on the rear of a button. Particularly, the mounting member is adapted to permit a button to be mounted thereon by sliding the member through the eyelet on the rear of the button. Means are preferably provided on the member to inhibit removal of the button once it is in place on the member. The member further comprises one of several known assemblies for releasably attaching the member, having a button mounted thereon, to another object, such as an article of clothing or preferably, the ear of an individual.

In one embodiment, the mounting member comprises a substantially U-shaped clip. A first leg of the clip is substantially flat, while the outer surface of the other leg of the clip has an indented portion intermediate the end of the leg and the base portion of the U-shaped clip. The legs of the clip are depressed substantially together at their outer ends and are mutually inserted through the eyelet on the rear of a button. During this insertion, the outer surface of the first leg slidingly engages the rear face of the button. The outer surface of the other leg slidingly engages the interior of the eyelet. Once insertion of the legs of the clip through the eyelet has begun, the clip need not be further depressed but will attempt to resiliently flex open within the eyelet. Insertion of the legs of the clip into the eyelet a sufficient distance will cause the eyelet to engage the indentation provided on the leg which is adjacent the interior of the eyelet. Thusly inserted, the mounting member with the button mounted thereon may be attached to the ear, or presumably other portions of the body or clothing, by a post or clip assembly provided on the mounting member. The overall size of the present invention may vary, but is intended to have dimensions less than the button to which it is applied so that it is concealed behind the button.

In another embodiment, the mounting member comprises a semi-flexible bow element. The member is slightly flexed for insertion of the member through the eyelet of a button. In place, the ends of the member engage the rear surface of the button while the central portion thereof arches upwardly such that a portion intermediate the ends of the member engages the interior of the eyelet. A pair of spaced-apart raised projections extending laterally across the bow element receive therebetween the interior wall of the bridge of the eyelet to retain the button on the mounting member. Post, clip, pin or other known means are provided for attachment of the device to an article or portion of the body.

In yet another embodiment, the mounting member substantially comprises an elongate beam. The beam is inserted through the eyelet of the button as described with respect to other embodiments herein. The beam has means to inhibit inadvertent removal of the button from the mounting member. Post, clip, pin, or other known means are provided on the member for attachment of the device to an article or portion of the body.

A general object of the present invention is to provide an earring or other article of jewelry for enhancing the visual consistency between the jewelry and garments an individual chooses to wear.

An object of the present invention is to provide a mounting member upon which a button having an eyelet thereon is mounted.

Another object of the present invention is to provide an mounting member which is releasably inserted through the eyelet in a button.

An object of the present invention is to provide a device for releasably engaging a button thereby forming a button earring.

BRIEF DESCRIPTION OF THE DRAWINGS

The objects and features of the invention noted above are explained in more detail with reference to the drawings, in which like reference numerals denote like elements, and in which:

FIG. 1 is an exploded rear perspective view of preferred components of the button jewelry of the present invention;

FIG. 2 is a rear plan view of the present invention;

FIG. 3 is a cross-sectional of the present invention showing the mounting member as it is inserted through the eyelet of a button;

FIG. 4 is a cross-sectional view taken along lines 4-4 of FIG. 2;

FIG. 5 is a cross-sectional view of the present invention showing an alternative assembly by which to attach the device to an article or portion of the body of an individual;

FIG. 6 is a perspective view showing an alternate embodiment of the present invention;

FIG. 7 is a cross-sectional view showing the embodiment of FIG. 6 attached to a button in accordance with the principles of the present invention;

FIG. 8 is a perspective view of another embodiment of the present invention; and FIG. 9 is a cross-sectional view showing the embodiment of FIG. 8 attached to a button is accordance with the principles of the present invention.

DETAILED DESCRIPTION OF THE INVENTION

With reference to FIG. 1, the button mounting member of a preferred embodiment of the present invention is generally denoted by reference numeral 10. A button 15 of the type generally found on clothing has a rear face 17 and an eyelet 19 thereon. Particularly, mounting member 10 generally comprises a substantially U-shaped clip 11 having a base portion 12 from which extends a first leg member 14 and a second leg member 16. Second leg member 16 includes an indented portion 21. As shown in the embodiment of FIG. 1, a connection assembly comprising a post 18 and a back member 20 is provided. Particularly, post 18 extends outwardly from second leg member 16. Back member 20 of the type commonly used with earrings for retaining the earring on a pierced ear has an aperture therein through which post 18 may be inserted. While it should be understood that mounting member 10 may be of various dimensions, the dimensions of mounting member 10 are preferably such that mounting member 10 is completely concealed behind button 15 when viewing button 15 from the front.

U-shaped clip 11 is preferably integrally formed from a single piece of material. It will be appreciated that mounting member 10 may be constructed of a variety of materials, and the present invention is not limited to the use of any particular material. Mounting member 10 is preferably constructed of surgical steal containing at least 3 percent gold. It has been found that such a material aids in the prevention of allergic reactions to mounting member 10.

Referring now to FIGS. 2–4, mounting member 10 is inserted through eyelet 19 of button 15. Particularly, as shown best in FIG. 3, first leg member 14 and second leg member 16 of U-shaped clip 11 are shown inserted through eyelet 19, as indicated by the arrow 22 of FIG. 3. Preferably, second leg member 16 has a slightly downwardly sloping outer portion to facilitate insertion of U-shaped clip 11 through eyelet 19. As leg members 14 and 16 are inserted into eyelet 19, the outer surface of first leg member 14 slidingly engages rear face 17 of button 15 and the outer surface of second leg member 16 slidingly engages at least a portion of the interior of eyelet 19.

As seen in FIG. 4, sufficient insertion of U-shaped clip 11 through eyelet 19 of button 15 causes at least a portion of the interior of eyelet 19 to engage the indented portion 21 of second leg member 16, thereby inhibiting further movement of mounting member 10 from eyelet 19. In such a position, second leg member 16 substantially returns to its non-pinched starting position due to the inherent memory of the U-shaped clip 11. It will be appreciated that once mounting member 10 is in place within eyelet 19 of button 15, in the embodiment shown, the outermost end of second leg member 16 may be depressed to permit removal of mounting member 10 from eyelet 19, namely by sliding it outwardly from eyelet 19.

In the embodiment shown in FIGS. 1–4, it will be appreciated that the connection assembly comprised of post 10 and back member 20 is utilized to fasten mounting member 10, preferably having thereon a button 15, to another article and preferably to the pierced ear of an individual. As shown in FIG. 5, the connection assembly may comprise a clip fastener 30 for attaching the present invention to the ear of an individual or to an other member or article. It will be appreciated that other attachment means, such as a safety-pin, may be utilized.

Referring now to FIGS. 6 and 7, an alternate embodiment of the present invention is shown. Particularly, a substantially bow-shaped mounting member 40, having end portions 41 and 43, is provided. Raised projections 42 and 44 preferably extend laterally across mounting member 40 at locations intermediate the ends of mounting member 40. As describe above, various known connection assemblies may be used in conjunction with mounting member 40. The connection assembly shown here are post 46 and back member 48. As shown in FIG. 7, a button is attached to bow-shaped mounting member 40 by inserting mounting member 40 through eyelet 19 of button 15. Inserting mounting member through eyelet 19 to the position shown requires mounting member 40 to be slightly flexed to permit projection 44 to clear eyelet 19. In place, end portions 41 and 43 engage the rear face 17 of button 15 and mounting member 40 is snugly engaged within eyelet 19 such that projections 42 and 44 engage a portion of eyelet 19 to inhibit movement of button 15 with respect to mounting member 40.

With reference to FIGS. 8 and 9, yet another preferred embodiment of the present invention is described. Particularly, a mounting member 50 generally comprises a beam. Preferably, beam mounting member 50 is hollow, or as shown, channel-shaped to reduce the overall weight of mounting member 50. A raised projection 52 is provided on mounting member 50. Spring catching means 54 are also provided on mounting member 50. As discussed above, various known connection assemblies may be utilized in conjunction with the present invention. As shown in FIGS. 8 and 9 for illustrative purposes, a post 56 and back member 58 are utilized. Similar to the above-described embodiments, mounting member 50 is inserted through eyelet 19 of button 15 a sufficient distance such that at least portions of eyelet 19 are engaged by projection 52 and spring catching means 54. The resulting snug engagement between mounting member 50 and eyelet 19 of button 15 inhibits unintentional movement of button 15 with respect to mounting member 50.

Spring catching means 54 operates such that it remains in the upwardly extending position shown in the absence of a force pushing it downwardly into the cutout portion 59 in mounting means 50 beneath spring catching means 54. Accordingly, as mounting means 50 is slidingly engaged through eyelet 19, the interior of eyelet 19 forces spring catching means 54 downwardly to permit eyelet 19 to pass over catching means 54. Once mounting means 50 is sufficiently inserted through eyelet 19 such that eyelet 19 has passed over spring catching means 54, spring catching means pops back upwardly into its starting position to inhibit removal of button 15 from mounting member 50. To remove button 15 from mounting member 50, spring catching means must be depressed while mounting member 50 is slid out of eyelet 19 of button 15.

The present invention provides a mounting member upon which a button may be releasably engaged, thereby resulting in unique jewelry items preferably utilized as earrings. In this regard, it will be appreciated by those skilled in the art that various forms and embodiments of the mounting member described herein may be constructed in accordance with the principles of the present invention. Additionally, various projections and spring catching means may be used in cooperation to inhibit movement of the button in relation to the mounting member.

Particularly, while the present invention may be utilized with any button having an eyelet thereon, it is particularly contemplated that the present invention will be utilized with designer buttons which match the buttons on clothing apparel. In this regard, it is contemplated that the mounting member, having a button mounted thereon, will be employed as an earring. Accordingly, it is preferred that the present invention is employed in pairs to provide a set of earrings which match the buttons of a particular garment of clothing.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A device comprising:

a button having a rear surface;

an eyelet defined by a spanning member fixedly positioned on said rear surface of said button, wherein said spanning member extends outwardly from said rear surface of said button and spans across a portion of said rear surface of said button between two locations, thereby forming said eyelet;

a mounting member inserted through said eyelet, wherein said mounting member is supported by said rear surface of said button and engages with said spanning member for rigidly retaining said button with said mounting member; and attaching means for attaching said device to an article or portion of the body of an individual.

2. The device as set forth in claim 1 wherein said attaching means further comprises:

a post extending outwardly from said mounting member; and a back member having an aperture therein through which said post may be inserted for securing said device to an article or portion of the body of an individual.

3. The device as set forth in claim 1 wherein said mounting attaching means further comprises:

a clip connected to said mounting member for clipping said device to an article or portion of the body of an individual.

4. The device as set forth in claim 1 wherein said mounting member further includes at least one raised projection for engaging at least a portion of said eyelet of said button.

5. The device as set forth in claim 4 wherein said mounting member further includes a pair of raised projections extending laterally across said mounting member for engaging opposite edges of said eyelet of said button.

6. The device as set forth in claim 4 wherein said raised projection is a spring activated element, whereby application of sufficient force on said upwardly extending spring activated element causes said element to be depressed while said force is present.

7. The device as set forth in claim 1 wherein said mounting member is a substantially bow-shaped element having first and second ends engaged with said button and a portion intermediate said first and second ends which engages a portion of said eyelet.

8. The device as set forth in claim 1 wherein said mounting member is a substantially beam-shaped element for releasably engaging said eyelet of said button.

9. The device as set forth in claim 1 wherein said mounting member is a substantially U-shaped member having first and second legs, at least one of which is adapted to be inserted through said eyelet of said button for releasably engaging said mounting member with said button.

10. The device as set forth in claim 9 wherein each said leg is adapted for insertion through said eyelet of said button for releasably engaging said mounting member with said button, whereby said at least one of said first and said second legs has an indented portion therein for engaging said eyelet of said button.

11. A device for making an article of jewelry out of a button, said button having an eyelet formed by a spanning member extending outwardly from one surface of said button and spanning a portion of said surface, said device comprising:

a mounting member adapted for insertion through said eyelet, wherein said mounting member is supported by said one surface of said button and said spanning member when positioned through said eyelet in normal use, to thereby releasably and rigidly secure said button with said mounting member; and attaching means for attaching said device to an article or portion of the body of an individual.

12. The device as set forth in claim 11 wherein said mounting member is resiliently flexible, whereby said mounting member is flexed during insertion through said eyelet.

13. The device as set forth in claim 12 wherein said mounting member comprises:

a U-shaped clip having a base portion, said U-shaped clip having first and second leg members extending outwardly in substantially the same direction from said base portion, wherein said first leg member is adapted to engage with said one surface of said button and said second leg member has an indented portion adapted to engage with said spanning member when said mounting member is inserted through said eyelet.

14. The device as set forth in claim 13 wherein said leg members are adapted to be substantially depressed together at ends thereof extending outwardly from said base portion to facilitate insertion of said clip through said eyelet.

15. The device as set forth in claim 14 wherein said clip is dimensioned so as to be concealed behind said button in normal use.

* * * * *